US012247446B2

(12) United States Patent
Newton et al.

(10) Patent No.: US 12,247,446 B2
(45) Date of Patent: Mar. 11, 2025

(54) METHOD AND APPARATUS FOR MOVING TUBULAR ROTARY SLIPS

(71) Applicant: Helmerich & Payne, Inc., Tulsa, OK (US)

(72) Inventors: Zachary L. Newton, Collinsville, OK (US); Brandon D. Valentine, Bixby, OK (US)

(73) Assignee: HELMERICH & PAYNE, INC., Tulsa, OK (US)

( * ) Notice: Subject to any disclaimer, the term of this patent is extended or adjusted under 35 U.S.C. 154(b) by 0 days.

(21) Appl. No.: 18/592,060

(22) Filed: Feb. 29, 2024

(65) Prior Publication Data

US 2024/0301755 A1 Sep. 12, 2024

Related U.S. Application Data

(60) Provisional application No. 63/488,705, filed on Mar. 6, 2023, provisional application No. 63/491,888, filed on Mar. 23, 2023.

(51) Int. Cl.
*E21B 19/10* (2006.01)
*E21B 3/02* (2006.01)
(Continued)

(52) U.S. Cl.
CPC ..... *E21B 19/10* (2013.01); *E21B 3/022* (2020.05); *E21B 19/06* (2013.01); *E21B 19/18* (2013.01); *E21B 34/02* (2013.01)

(58) Field of Classification Search
CPC ..... E21B 19/10
See application file for complete search history.

(56) References Cited

U.S. PATENT DOCUMENTS 1,543,904 A * 6/1925 Carr ..... E21B 19/10 188/67
2,340,597 A * 2/1944 Kelley ..... E21B 19/10 188/67
(Continued)

FOREIGN PATENT DOCUMENTS

CN 200940453 Y * 8/2007
CN 102287149 A * 12/2011
(Continued)

OTHER PUBLICATIONS

PCT/US2024/017934, "International Search Report and Written Opinion", Jul. 22, 2024, 12 pages.

*Primary Examiner* — Aaron L Lembo
(74) *Attorney, Agent, or Firm* — Kilpatrick Townsend & Stockton LLP

(57) ABSTRACT

A rotary slips lift system for oilfield tubulars includes a movable base adapted to move between a first position and a second position where the first position is closer to a bowl in a drilling rig floor than the second position. The system further includes a lifting arm having a first end and a second end where the second end is pivotally coupled to the movable base and where the lifting arm has a first arm position and a second arm position. The system further includes a rotary slips where the rotary slips is removably coupled to the first end of the lifting arm and where the rotary slips is adapted to be in a first slips position when the lifting arm is in the first arm position and the movable base is in the first position.

19 Claims, 12 Drawing Sheets

(51) Int. Cl.

| | |
|---|---|
| ***E21B 19/06*** | (2006.01) |
| ***E21B 19/18*** | (2006.01) |
| ***E21B 34/02*** | (2006.01) |

(56) References Cited

U.S. PATENT DOCUMENTS

| | | | | | |
|---|---|---|---|---|---|
| 2,570,039 | A * | 10/1951 | Stone | E21B 19/10 | 188/67 |
| 2,575,356 | A * | 11/1951 | Mullinix | E21B 19/10 | 188/63 |
| 3,097,409 | A * | 7/1963 | Kelley | E21B 19/10 | 74/110 |
| 3,514,822 | A * | 6/1970 | William | E21B 19/10 | 414/744.2 |
| 3,579,753 | A * | 5/1971 | Pryor | E21B 19/07 | 188/67 |
| 3,961,399 | A * | 6/1976 | Boyadjieff | E21B 19/168 | 188/67 |
| 4,715,456 | A * | 12/1987 | Poe, Jr. | E21B 19/10 | 188/67 |
| 5,335,756 | A * | 8/1994 | Penisson | E21B 19/10 | 188/67 |
| 6,644,413 | B2 * | 11/2003 | Adams | E21B 33/043 | 175/203 |
| 6,920,931 | B1 * | 7/2005 | Webre | E21B 19/22 | 166/77.1 |
| 6,948,575 | B1 * | 9/2005 | Mosing | E21B 19/00 | 166/380 |
| 6,948,904 | B2 * | 9/2005 | Bunn | E21B 19/10 | 294/198 |
| 7,293,618 | B2 * | 11/2007 | Belik | E21B 19/10 | 166/382 |
| 7,395,855 | B2 * | 7/2008 | Ayling | E21B 19/10 | 188/67 |
| 7,419,008 | B2 * | 9/2008 | Campisi | E21B 19/10 | 166/77.1 |
| 8,678,088 | B2 * | 3/2014 | Brown | E21B 19/00 | 166/54.5 |
| 9,284,792 | B2 * | 3/2016 | Webre | E21B 19/10 | |
| 9,416,602 | B2 * | 8/2016 | Mosing | E21B 19/07 | |
| 9,546,525 | B2 * | 1/2017 | Mosing | E21B 19/07 | |
| 10,760,356 | B2 * | 9/2020 | Meeks | E21B 19/09 | |
| 2007/0017681 | A1 * | 1/2007 | Dykesteen | E21B 19/084 | 166/77.51 |
| 2007/0235229 | A1 * | 10/2007 | Henderson | E21B 19/10 | 175/423 |
| 2014/0041854 | A1 * | 2/2014 | Robichaux | E21B 19/10 | 166/77.52 |
| 2015/0107857 | A1 | 4/2015 | Mosing et al. | | |
| 2024/0159114 | A1 * | 5/2024 | Coyle, Jr. | E21B 19/07 | |

FOREIGN PATENT DOCUMENTS

| | | | | | |
|---|---|---|---|---|---|
| CN | 204877313 | U | * | 12/2015 | |
| CN | 113153181 | A | * | 7/2021 | E21B 19/10 |
| GB | 2577290 | A | | 3/2020 | |
| GB | 2588416 | A | * | 4/2021 | B25J 11/00 |
| WO | 03054343 | A1 | | 7/2003 | |

* cited by examiner

METHOD AND APPARATUS FOR MOVING TUBULAR ROTARY SLIPS

CROSS REFERENCE TO RELATED APPLICATIONS

The present application claims the benefit of priority to U.S. Provisional Patent Application No. 63/488,705 filed Mar. 6, 2023, entitled "Method and Apparatus for Moving Tubular Rotary Slips," the contents of which are incorporated herein by reference in their entirety for all purposes. The present application also claims the benefit of priority to U.S. Provisional Patent Application No. 63/491,888 filed Mar. 23, 2023, entitled "Systems and Methods for Make-up and Break-out of Drill Pipe," the contents of which are incorporated herein by reference in their entirety for all purposes.

This application is related to the commonly assigned and concurrently filed patent applications, the disclosure which are incorporated herein by reference in its entirety for all purposes: U.S. patent application Ser. No. 18/592,353, filed Feb. 29, 2024, entitled "Systems and Methods for Make-up and Break-out of Drill Pipe," which claims the benefit of priority to U.S. Provisional Patent Application No. 63/491,888, filed Mar. 23, 2023, and entitled "Systems and Methods for Make-Up and Break-Out of Drill Pipe."

BACKGROUND OF THE INVENTION

In the oil and gas industry, extraction of hydrocarbon natural resources is done by physically drilling a hole to a reservoir where the hydrocarbon natural resources are trapped. The hydrocarbon natural resources can be up to 10,000 feet or more below the ground surface and be in and/or under various layers of geological formations. To run the drillstring downhole, tools such as rotary slips, torque wrenches, and iron roughnecks may aid in coupling joints of drill pipe together as the drill pipe is being run into the wellbore. The tools may also aid in breaking out the drill pipe when the drillstring is removed from the wellbore. Rotary slips may be mountable in a rotary table for gripping and releasing a tubular being run down hole into and/or being pulled out of a well. Iron roughnecks may be used to couple joints of drill pipe together as the drill pipe is run into the wellbore or to decouple joints of drill pipe as the drill pipe is removed from the wellbore. Iron roughnecks may apply a torque to a length of drill pipe using tongs while another length of drill pipe is threaded onto an end of the first length. The spinners of the iron roughneck may turn a length of drill pipe to thread it onto a second length of pipe while a lower drill pipe is held in place with the torque wrench/tongs. At times, the rotary slips may secure and hold onto a part of the drill pipe while an additional drill pipe is added to or removed from the pipe secured by the rotary slips.

Rotary slips are used to grip a piece of drill pipe (often as part of a drillstring) in a relatively non-damaging manner and suspend the drillstring, such during a make-up or during a breakout. According to various available designs, rotary slips generally include three or more steel wedges that are hinged together to form a perimeter around the drillpipe. The rotary slips are often fitted with replaceable, hardened tool steel teeth that embed slightly into the outside of the drillpipe for securing the drillpipe in position. Furthermore, the rotary slips may be tapered to match the taper of the rotary table. During operation and lowering of the drillpipe, the teeth of the rotary slips grip the drillpipe and are pulled down, thereby creating a compressive force inward on the drillpipe, and effectively locking the components relative to each other. The drillstring is raised to unlock the gripping action of the slips, and the slips are removed from the rotary table.

This disclosure relates to drilling operations and equipment and methods for the same, and in particular, but not limited to, to improved systems and methods relating to lifting and setting tubular rotary slips.

SUMMARY OF THE INVENTION

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to one embodiment, a rotary slips lift system for oilfield tubulars includes a movable base adapted to move between a first position and a second position where the first position is closer to a bowl in a drilling rig floor than the second position. The system further includes a lifting arm having a first end and a second end where the second end is pivotally coupled to the movable base and where the lifting arm has a first arm position and a second arm position. The system further includes a rotary slips where the rotary slips is removably coupled to the first end of the lifting arm and where the rotary slips is adapted to be in a first slips position when the lifting arm is in the first arm position and the movable base is in the first position. The rotary slips is adapted to be in a second slips position when the lifting arm is in the second arm position and the movable base is in the second position. The first slips position includes being at least partially located in the bowl and the second slips position includes being out of the bowl. The lifting arm is adapted to lift the rotary slips out of the bowl when moving from the first arm position to the second arm position.

The system may include various optional embodiments. The first end of the lifting arm may be removably coupled to the rotary slips by an adapter that is operable to be removably coupled to a plurality of rotary slips of different dimensions. The system may include a base plate track where the movable base may be movably mounted on the base plate track. The system may further include a linkage assembly where the linkage assembly may removably couple the first end of the lifting arm to the rotary slips and where the linkage assembly may include a pinned universal linkage adapter and at least one spring. The system may further include a trunnion mounted cylinder adapted to move the lifting arm between the first arm position and the second arm position. The system may further include a cylinder mounted to the movable base and adapted to move the movable base between the first position and the second position. The system may further include a control system coupled to the movable base and the lifting arm where the control system is adapted to selectively move the movable base and the lifting arm in response to an operator command therefor. The system may further include a control system coupled to the movable base and the lifting arm where the control system is adapted to automatically move the movable base and the lifting arm in response to a control signal from a second control system. The control signal may be associated with a signal indicating that a make-up has been completed or a breakout has been completed.

According to another embodiment, a method of controlling movement of rotary slips includes providing an assembly including a lifting arm where the lifting arm includes a first end and a second end and where the first end of the lifting arm is adapted to be removably coupled to the rotary slips. The lifting arm is further adapted to move between a first arm position and a second arm position. The assembly further includes a movable base where the movable base is movable between a first position and a second position and where the second end of the lifting arm is coupled to the movable base. The method further includes moving the lifting arm to the first arm position where moving the lifting arm to the first arm position includes lowering at least the first end of the lifting arm, thereby placing at least a portion of the rotary slips in a bowl of a drilling rig floor. The method further includes moving the movable base to the first position where a portion of the movable base is proximal the bowl in the first position and, upon completion of a makeup or breakout of a pipe, moving the lifting arm to the second arm position. Moving the lifting arm to the second arm position includes raising at least the first end of the lifting arm, thereby removing the rotary slips from the bowl. The method further includes moving the movable base to the second position where the first position is closer to the bowl than the second position.

The method may include various optional embodiments. The method may include replacing the rotary slips with additional rotary slips where the rotary slips and additional slips are adapted for different pipe diameters. The method may further include providing a base track plate attached to the drilling rig floor and adapted to allow movement of the movable base thereon. The assembly may further include a control system coupled to the lifting arm and the movable base where the control system is adapted to control the movement of the lifting arm or the movable base. The control system may be adapted to control the movement of the lifting arm and the movable base simultaneously. The control system may be adapted to receive one or more signals indicating that a makeup or breakout has been completed, is in process, or is about to begin. The control system may be adapted to initiate, cease, slow, or increase a speed of operation of the lifting arm or the movable base in response to one or more signals indicating an unsafe condition.

According to yet another embodiment, a rotary slips system includes a movable base adapted to move between a first position and a second position where the first position is closer to a bowl in a drilling rig floor than the second position. The system further includes a lifting arm having a first end and a second end where the first end of the lifting arm is adapted to be removably coupled to a slips and the second end of the lifting arm is pivotally coupled to the movable base. The lifting arm has a first arm position and second arm position where the first end of the lifting arm is lower in the first arm position than in the second arm position. When the lifting arm is in the first arm position and the movable base is in the first position and a slips is coupled to the first end of the lifting arm, the slips is located at least partially in the bowl, and when the lifting arm is in the second arm position and the movable base is in the second position, the slips is out of the bowl. The system further includes a means for moving the lifting arm and a means for moving the movable base.

The system may include various optional embodiments. The system may include a control system coupled to the lifting arm or the movable base where the control system is adapted to move the lifting arm or the movable base, respectively, in response to a user command. The system may include a control system coupled to the lifting arm and the movable base where the control system is adapted to control movement of the lifting arm and the movable base. The system may include a control system coupled to the lifting arm and the movable base where the control system is adapted to control movement of the lifting arm and the movable base responsive to a signal indicating completion of a makeup or breakout.

DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

DETAILED DESCRIPTION

Figure 1A:
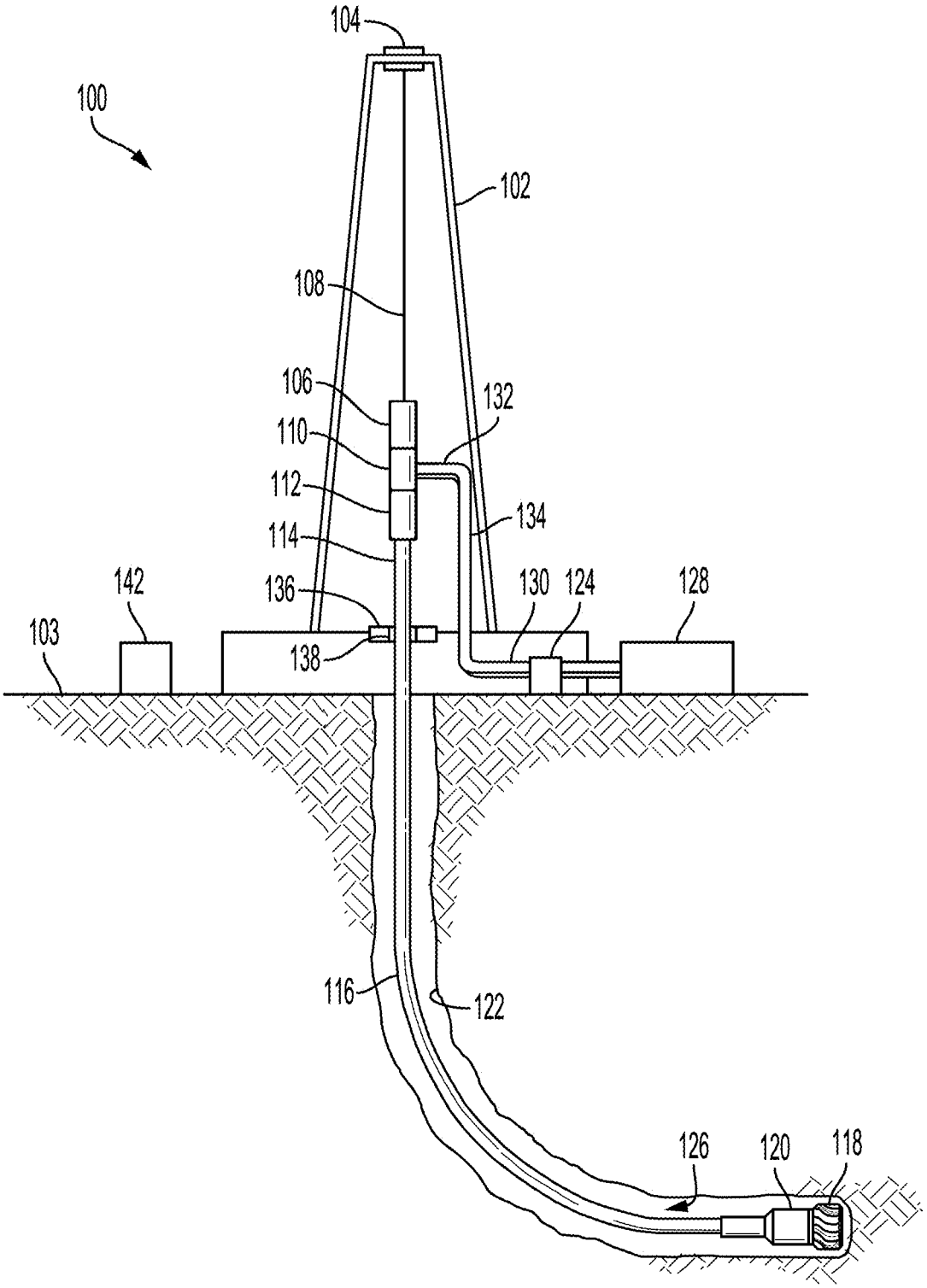
FIG. 1A illustrates one embodiment of a drilling system, in accordance with some embodiments of the present disclosure.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

Rotary slips may be mountable in a rotary table for gripping and releasing a drillpipe down hole into (i.e., during make-up) and/or being pulled out of a well (e.g., during breakout of a well). The rotary slips may secure and hold onto a part of the drillpipe while an additional pipe joint, pipe joints, stand of pipe, or other tubular is added to or removed from the drillpipe secured by the rotary slips.

Various embodiments of the present disclosure provide an apparatus for lifting and setting rotary slips in a safe and efficient manner. In particular, one having ordinary skill in the art would appreciate that drillpipe, and components related thereto, are often relatively heavy and unwieldy to work with and manage. Accordingly, the safety of the operators in the field is at a heightened risk when moving and managing drillpipe or the like. Conventional rotary slip designs require a rig crew to place the rotary slips around the drillpipe themselves and position the rotary slips and drillpipe in the rotary table as a driller slowly lowers the drawstring. The apparatus described herein addresses the need in the art for a safer method of placing and securing rotary slips to a drillpipe.

The apparatus described herein may include a movable base that slides toward and away from the drillpipe. The apparatus engages the rotary slips around the drillpipe when the apparatus is proximate to the drillpipe, thereby reducing the time that the rig crew is positioned relative to heavy equipment in various stages of being secured in place. Advantageously, the apparatus maintains the rotary slips relative to the drillpipe as additional drillpipe is added or as other operations are performed. When the drillpipe is ready to be lowered to its next position, the apparatus disengages the rotary slips from the drillpipe and moves the rotary slips away from the drillpipe and rotary table without the rig crew having to approach the rotary table. The apparatus according to at least some of the embodiments described herein provides a safe way for operators to remotely secure drillpipe in the rotary slips and remove the rotary slips from the rotary tablet compared to conventional methods.

According to embodiments of the present disclosure, an apparatus for lifting and setting rotary slips in a drilling rig may include a lifting arm, a cylinder, a linkage assembly, and movable or sliding base. The lifting arm may be coupled to the rotary slips via a linkage assembly. The linkage assembly may include a link arm and one or more extension guide springs. The linkage assembly may include a universal linkage adapter sized and shaped to couple with a variety of rotary slips brands, models, manufacturers, and/or sizes or a plurality of adapters sized and shaped to couple with different rotary slips brands, models, manufacturers, and/or sizes. The lifting arm may be pivotally mounted to the sliding base and to a cylinder, so that when the cylinder is actuated the rotary slips may be lifted and moved between a first position and a second position. The apparatus may incorporate a mechanical load-holding position to eliminate the risk of lost system pressure. The sliding base may be coupled to a cylinder actuated base plate so that when actuated, the sliding base, lifting arm, and rotary slips are retracted to a storage position (e.g., for drilling operations). The base plate may be set in the rotary table pin drive master bushings. The method of lifting and setting the rotary slips may be controlled through a controller or controller system such as a programmable logic controller (PLC). In some aspects, the lifting and setting of the rotary slips may be controlled utilizing solenoid actuated valves and an electronic input switch.

Referring to FIG. 1A, an embodiment of a drilling environment 100 is depicted. Although the environment 100 is a drilling environment that is described with a top drive drilling system, it is understood that other embodiments may include other drilling systems, such as rotary table systems.

In the present example, the environment 100 includes a derrick 102 on a surface 103. The derrick 102 includes a crown block 104. A traveling block 106 is coupled to the crown block 104 via a drilling line 108. In a top drive system (as illustrated), a top drive 110 is coupled to the traveling block 106 and provides the rotational force needed for drilling. A saver sub 112 may sit between the top drive 110 and a drill pipe 114 that is part of a drillstring 116. The top drive 110 rotates the drillstring 116 via the saver sub 112, which in turn rotates a drill bit 118 of a BHA 120 in a borehole 122 in a formation. A mud pump 124 may direct a fluid mixture (e.g., mud) 126 from a mud pit or other container 128 into the borehole 122. The mud 126 may flow from the mud pump 124 into a discharge line 130 that is coupled to a rotary hose 132 by a standpipe 134. The rotary hose 132 is coupled to the top drive 110, which includes a passage for the mud 126 to flow into the drillstring 116 and the borehole 122. A rotary table 136 may be fitted with a master bushing 138 to hold the drillstring 116 when the drillstring is not rotating.

Some or all of a control system 142 may be located at the derrick 102, may be downhole, and/or may be remote from the actual drilling location. For example, the control system 142 may be a system such as is disclosed in U.S. Pat. No. 8,210,283 entitled SYSTEM AND METHOD FOR SURFACE STEERABLE DRILLING, filed on Dec. 22, 2011, and issued on Jul. 3, 2012, which is hereby incorporated by reference in its entirety. Alternatively, the control system 142 may be a standalone system or may be incorporated into other systems at the derrick 102. The control system 142 may communicate via a wired and/or wireless connection (not shown).

Figure 1B:
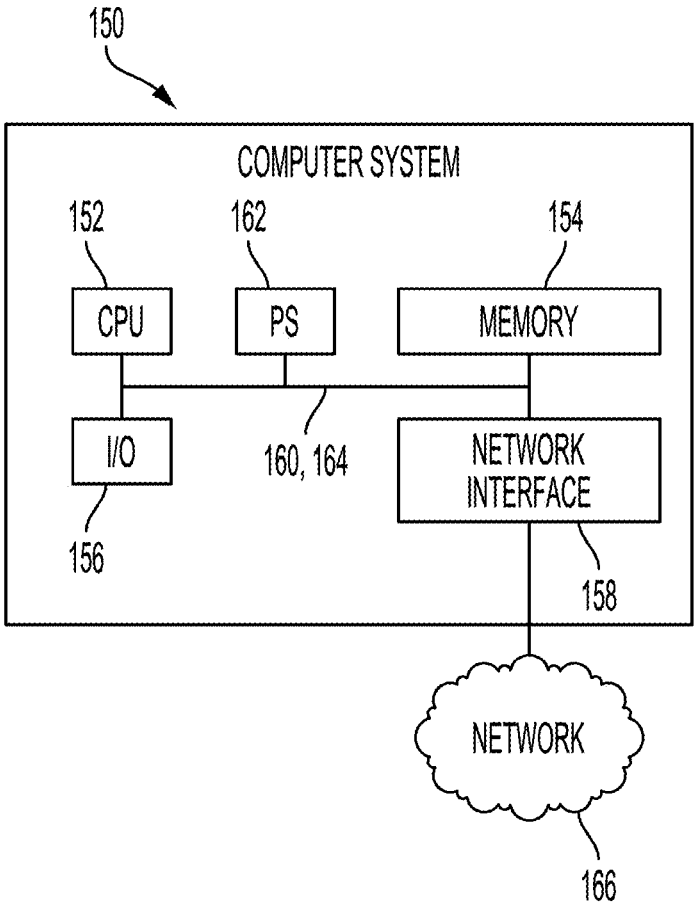
FIG. 1B illustrates one embodiment of a computer system that may be used within the environment of FIG. 1A, in accordance with some embodiments of the present disclosure.

Referring to FIG. 1B, one embodiment of a computer system 150 is illustrated. The computer system 150 is one possible example of a system component or device such as the control system 142 of FIG. 1A or a separate system used to perform the various processes described herein. In scenarios where the computer system 150 is on-site, such as within the environment 100 of FIG. 1A, the computer system may be contained in a relatively rugged, shock-resistant case that is hardened for industrial applications and harsh environments. It is understood that downhole electronics may be mounted in an adaptive suspension system that uses active dampening as described in various embodiments herein.

The computer system 150 may include a central processing unit ("CPU") 152, a memory unit 154, an input/output ("1/0") device 156, and a network interface 158. The components 152, 154, 156, and 158 are interconnected by a transport system (e.g., a bus) 160. A power supply (PS) 162 may provide power to components of the computer system 150 via a power transport system 164 (shown with data transport system 160, although the power and data transport systems may be separate).

It is understood that the computer system 150 may be differently configured and that each of the listed components may actually represent several different components. For example, the CPU 152 may actually represent a multiprocessor or a distributed processing system; the memory unit 154 may include different levels of cache memory, main memory, hard disks, and remote storage locations; the I/O device 156 may include monitors, keyboards, and the like; and the network interface 158 may include one or more network cards providing one or more wired and/or wireless connections to a network 166. Therefore, a wide range of flexibility is anticipated in the configuration of the computer system 150.

The computer system 150 may use any operating system (or multiple operating systems), including various versions of operating systems provided by Microsoft (such as WINDOWS), Apple (such as Mac OS X), UNIX, and LINUX, and may include operating systems specifically developed for handheld devices, personal computers, and servers depending on the use of the computer system 150. The operating system, as well as other instructions (e.g., software instructions for performing the functionality described in previous embodiments) may be stored in the memory unit 154 and executed by the processor 152. For example, the memory unit 154 may include instructions for performing the various methods and control functions disclosed herein.

The network 166 may be a single network or may represent multiple networks, including networks of different types. For example, the network 166 may include one or more cellular links, data packet networks such as the Internet, local area networks (LANs), and/or wide local area networks (WLAN), and/or Public Switched Telephone Networks (PSTNs). Accordingly, many different network types and configurations may be used to couple the computer system 150 to other components of the environment 100 of FIG. 1A and/or to other systems not shown (e.g., remote systems).

Figure 2:
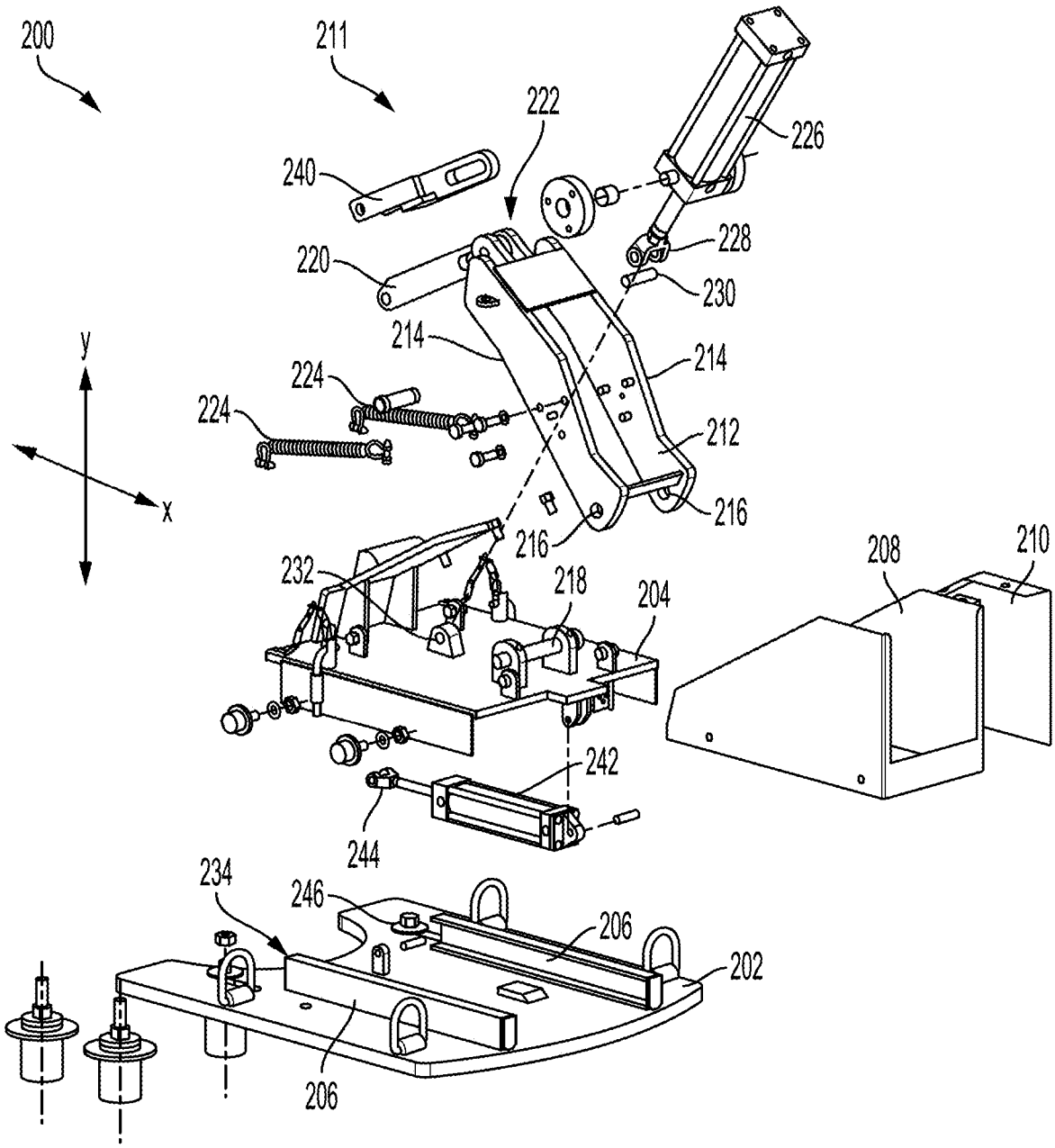
FIG. 2 illustrates an exploded view of an apparatus for lifting tubular rotary slips, in accordance with some embodiments of the present disclosure.

FIG. 2 illustrates an exploded view of an apparatus 200 for lifting tubular rotary slips according to some embodiments of the present disclosure. As shown in FIG. 2, the apparatus 200 is uncoupled from a rotary slip (not shown). Apparatus 200 includes a base plate 202. Base plate 202 may be movable in a vertical direction (i.e., along the y-axis depicted in FIG. 2) relative to the ground during use. According to at least some embodiments, base plate 202 may be a pneumatic slip lifter base plate. The base plate 202 may include a sliding base 204 that slides along one or more tracks 206 of the base plate 202. For example, the sliding base 204 slides laterally (e.g., along the x-axis depicted in FIG. 2) relative to the base plate 202. The one or more tracks 206 may be sized and shaped to receive projections or corresponding tracks of the sliding base 204 such that the sliding base 204 may move forward and/or backward (i.e., laterally) along the one or more tracks 206. The combination of the base plate 202 and the one or more tracks 206 may be referred to as a base plate track in various embodiments.

According to at least some embodiments, the apparatus 200 includes a cover 208 and a cover guard 210 for protecting various internal components of the apparatus 200 when the apparatus 200 is in an assembled position, as described and shown in detail below with respect to at least FIG. 3. In some embodiments, the cover 208 and/or the cover guard 210 may be removably couplable to the sliding base 204.

The apparatus 200 may include a lifting arm 212 that may be an integrated component or may be formed of one or more components. For example, the lifting arm 212 may include a pair of sidebars 214 defining the lifting arm 212. The sidebars 214 may each define one or more openings 216. As shown in FIG. 2, in some embodiments, a lifting arm pin 218 for securing the lifting arm 212 to the base 204 of the apparatus 200 in the assembled configuration may pass through an opposing pair of the one or more openings 216 of the lifting arm 212. In various embodiments, the lifting arm 212 may be coupled to the sliding base 204 such that the lifting arm 212 may rotate about the lifting arm pin 218 relative to the sliding base 204.

In some embodiments, the apparatus 200 further includes a linkage assembly 211 including a link arm 220. The link arm 220 may be removably coupled to the lifting arm 212 at a first end 222 of the link arm 220. In at least some embodiments, the link arm 220 is coupled using a pin (not shown) that the link arm 220 rotates about relative to the lifting arm 212 as would be further appreciated by on having ordinary skill in the art upon reading the present disclosure. The link arm 220 may be further removably coupled to the lifting arm 212 via one or more springs 224. The link arm 220 and the one or more springs 224 may together define the linkage assembly. The link arm 220 may be a pinned universal linkage adapter that may be selected for use with particular rotary slips as would be determinable by one having ordinary skill in the art.

Figure 6:
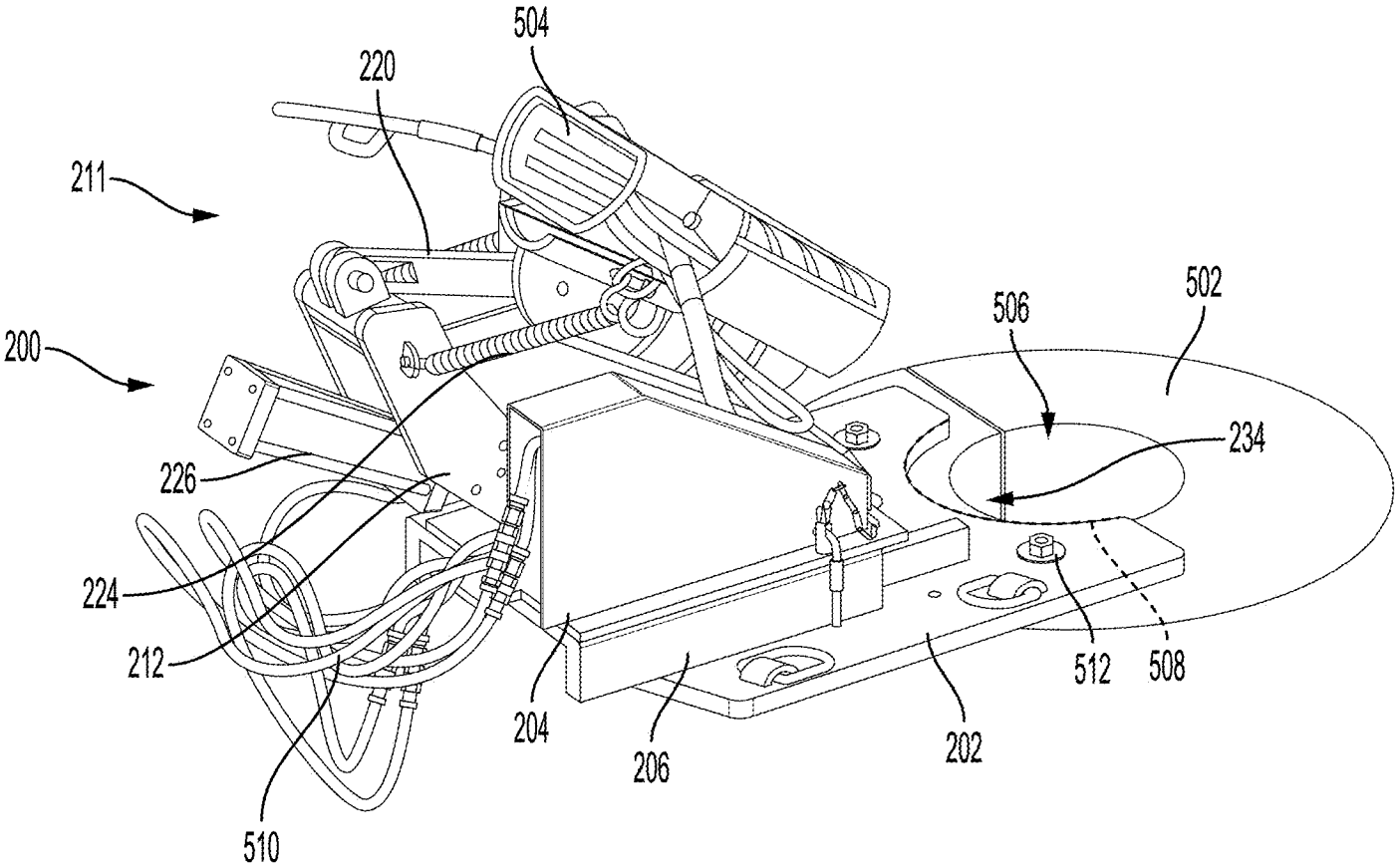
FIG. 6 illustrates an apparatus for moving tubular rotary slips, in accordance with some embodiments of the present disclosure.
Figure 7:
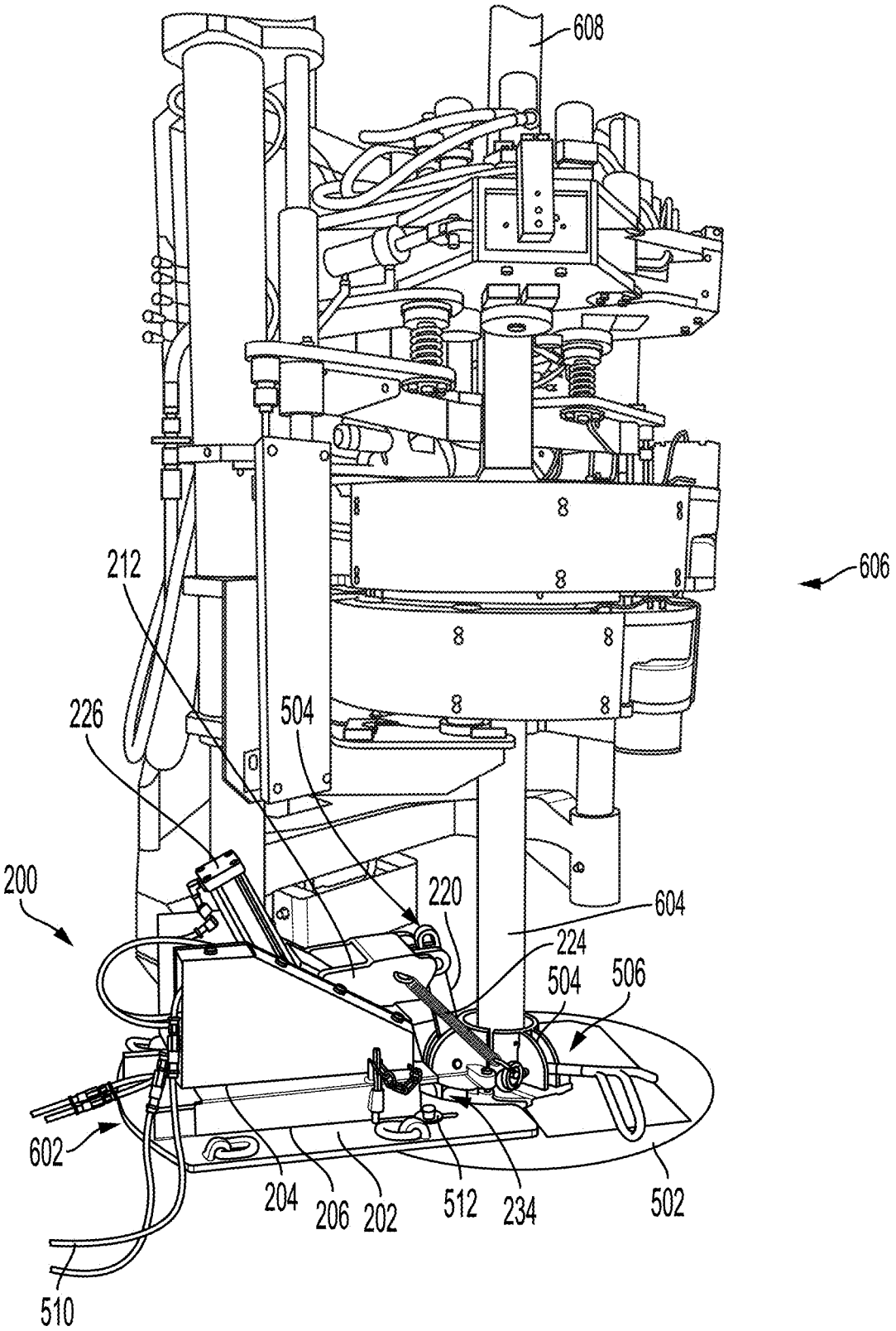
FIG. 7 illustrates an apparatus in a secured or engaged position in which rotary slips surround a drillpipe and extend into the bowl of a rotary table, in accordance with some embodiments of the present disclosure.

As further shown in FIG. 2, the apparatus 200 includes a cylinder 226. The cylinder 226 may be a pneumatic cylinder, a hydraulic cylinder, or the like. The cylinder 226 further includes a cylinder clevis 228. A pin 230 may pass through the cylinder clevis 228. The pin 230 secures the cylinder 226 to the sliding base 204 by passing through a corresponding opening 232 in the sliding base 204. According to various embodiments, the cylinder 226 controls the position of the lifting arm 212. For example, the apparatus 200 may include a trunnion (not shown) mounted to the cylinder 226 adapted to move the lifting arm 212 between a first arm position and a second arm position. In particular, the cylinder 226 controls the position of the lifting arm 212 between at least a first position (interchangeably referred to as a first use position) and a second position (interchangeably referred to as a second stored position) to be illustrated in further detail below. The position of the lifting arm 212 and the sliding base 204 may control the position of one or more rotary slips (not shown) that may be removably coupled to the apparatus 200. For example, the second position of the apparatus 200 may correspond to a transport, stored, or other position in which the rotary slips are not within a bowl of a rotary table such that the rotary slips are not engaged with a drillpipe, for example as depicted in FIG. 6. Furthermore, the second position of the apparatus 200 is associated with the rotary slips being in a first slips position when the lifting arm is in a first arm position. Even further, the first position of the apparatus 200 is associated with the rotary slips being in a second slips position when the lifting arm is in a second arm position. In particular, in the first slips position, the rotary slips are at least partially located in the bowl of the rotary table, and, in the second slips position, the rotary slips are out of the bowl out of the rotary table. The first position of the apparatus 200 may correspond to a use position in which the rotary slips are positioned within the bowl of the rotary table, for example as depicted in FIG. 7. In the first position (e.g., the use position), the lifting arm 212 may be rotated in a forward direction, e.g., along the x-axis, toward a front edge 234 of the base plate 202 for positioning the rotary slips within the bowl of the rotary table for engagement with the drillpipe positioned therein. In at least some embodiments, the one or more springs 224 may aid in guiding the rotary slips into position within the bowl of the rotary table. Accordingly, the position of the rotary slips may be controlled and maintained in relation to the position of at least the lifting arm 212 and the sliding base 204.

According to various embodiments, the apparatus 200 may further include a pneumatic slip lifter link arm 240. The pneumatic slip lifter link arm 240 may be used instead of the link arm 220. For example, the link arm 220 may be for use with rotary slips of a particular size, brand, or manufacturer and the pneumatic slip lifter link arm 240 may be used with slips of a different size, brand, or manufacturer. Accordingly, the apparatus 200 may be configured to be used with various rotary slips corresponding to one or more different brands, models, sizes, and/or types of rotary slips.

The apparatus may further include an additional cylinder 242. The additional cylinder 242 may include a cylinder clevis 244 through which a pin 246 may extend through for securing the additional cylinder 242 to the base plate 202. The additional cylinder 242 may be a pneumatic cylinder or a hydraulic cylinder. The additional cylinder 242 may be removably coupled to the base plate 202 to further control the position of the sliding base 204 relative to the base plate 202 by controlling the movement of the sliding base 204 along the one or more tracks 206 on the base plate 202. As previously discussed, the position of the sliding base 204 may also contribute to the positioning of the lifting arm 212 and thereby the positioning of the link arm 220 and the rotary slips (not shown) coupled thereto. One or more pneumatic or hydraulic lines (not shown) may couple the cylinder 226 and/or the additional cylinder 242 to an air supply or a hydraulic fluid supply, as appropriate. The apparatus 200 may further control the actuation of one or more rotary slips using one or more hydraulic or pneumatic lines.

According to various embodiments of the present disclosure, an apparatus, such as apparatus 200, may also include a control system (not shown) adapted to selectively move the sliding base 204 and the lifting arm 212 in response to a command from an operator. The control system may be a programmable logic controller (PLC) coupled to the cylinder 226 and/or the additional cylinder 242 for controlling the actuation of the cylinder 226 and/or the additional cylinder 242. In some embodiments, the control system is adapted to automatically move the sliding base 204 and the lifting arm 212 in response to a control signal from a second control system. The control signal may be signal indicating that a makeup has been completed or a breakout has been completed. In various embodiments, the apparatus 200 may include a one or more control systems, such as control system 150 described with respect to FIG. 1B above. In further embodiments, one or more operations of the apparatus 200 may be automatically performed in response to commands from the one or more control systems. The apparatus 200 operating the rotary slips may be automated, in whole or in part, according to at least some embodiments.

In further embodiments, the assembled apparatus 200 as shown and described herein may be used to make up and/or break out pipe from a drillstring. For example, the apparatus 200 may be used to connect tubulars via threaded connections incorporated at either end of the tubulars (or tools to be connected thereto). The apparatus 200 may be used to support the tubulars as they are torqued to the correct value to ensure a secure tool string without damaging the tubular bodies. In another example, the apparatus 200 may support tubulars during a process of unscrewing drillstring components, which are coupled by various threadforms (e.g., connections), including tool joints and other threaded connections.

Figure 3:
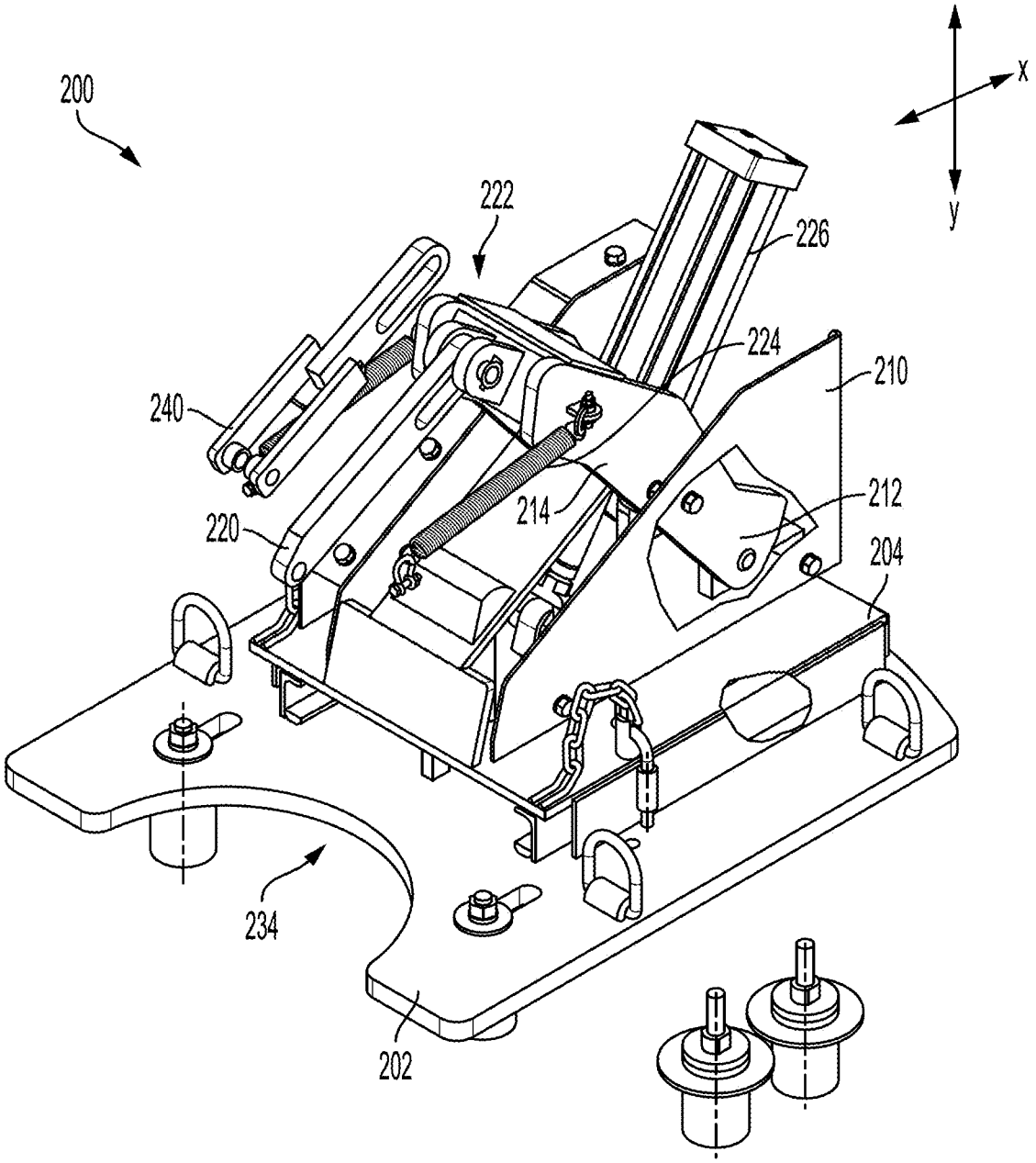
FIG. 3 illustrates an isometric view of an assembled apparatus for lifting tubular rotary slips, in accordance with some embodiments of the present disclosure.

FIG. 3 illustrates an isometric view of an assembled apparatus 200 for lifting tubular rotary slips. Description of apparatus 200 at least with respect to FIG. 2 is relevant to the description of the isometric view of an assembled apparatus for lifting tubular rotary slips described herein. Accordingly, similarly labeled components have similar form and function unless otherwise noted herein. As shown in FIG. 3, various components of described in detail above with respect to FIG. 2 are shown in an assembled configuration.

Figure 4:
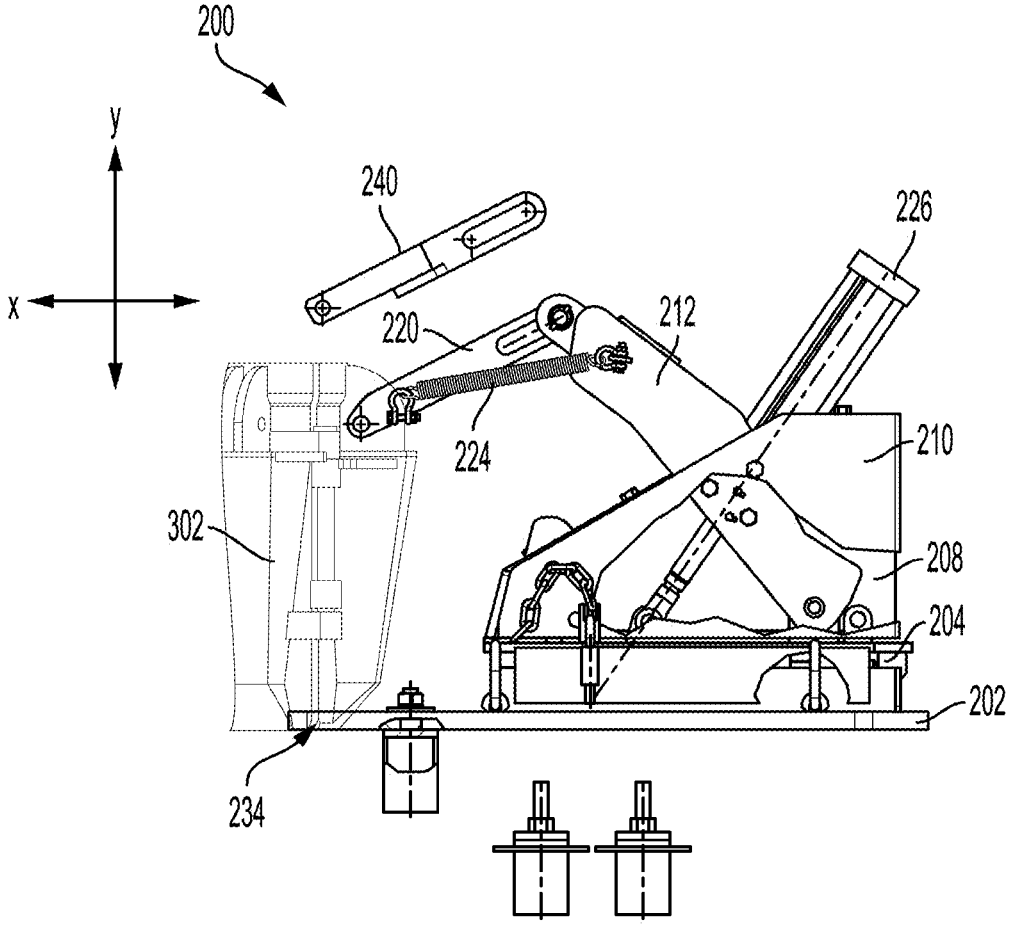
FIG. 4 illustrates a right side view of an assembled apparatus for lifting tubular rotary slips, in accordance with some embodiments of the present disclosure.

FIG. 4 illustrates a right side view of the assembled apparatus 200 for lifting tubular rotary slips coupled to exemplary rotary slips 302. In particular, the rotary slips 302 are held and secured by the link arm 220 positioned toward the front edge 234 of the base plate 202. The cylinder 226 positions the link arm 220 toward the front edge 234 of the base plate 202 causing tension in the one or more springs 224 that bring the link arm 220 back to a first position after releasing or otherwise decoupling the rotary slips 302 from the link arm 220.

Figure 5:
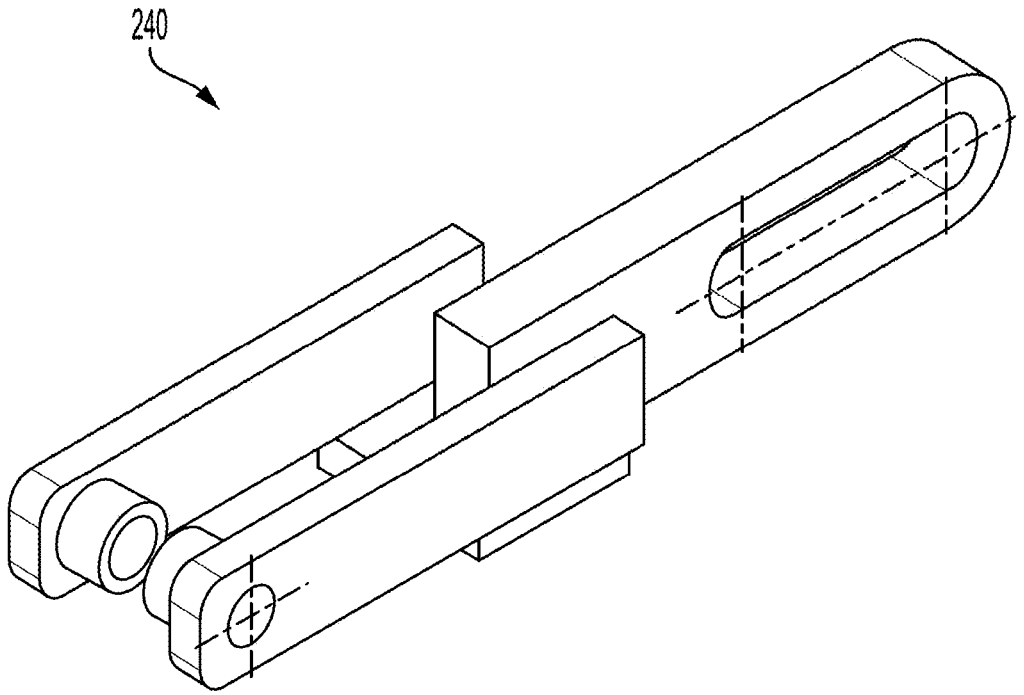
FIG. 5 illustrates a link arm for use with an apparatus for lifting tubular rotary slips, in accordance with some embodiments of the present disclosure.

FIG. 5 illustrates a link arm for use with an apparatus for lifting tubular rotary slips. Description of apparatus 200 at least with respect to FIGS. 2-3 is relevant to the description of the link arm for use with an apparatus for lifting tubular rotary slips described herein. Accordingly, similarly labeled components have similar form and function unless otherwise noted herein. As shown in FIG. 5, the link arm is a pneumatic slip lifter link arm 240. The pneumatic slip lifter link arm 240 may be used instead of the link arm 220. For example, the link arm 220 may be for use with rotary slips of a particular size, brand, or manufacturer and the pneumatic slip lifter link arm 240 may be used with slips of a different size, brand, or manufacturer. Accordingly, the apparatus 200 may be configured to be used with various rotary slips corresponding to one or more different brands, models, sizes, and/or types of rotary slips. In one particular embodiment, the pneumatic slip lifter link arm 240 may be used with either Den-Con or Vacro style rotary slips.

FIG. 6 illustrates an apparatus for moving tubular rotary slips positioned at a wellbore, according to embodiments of the present disclosure. Description of apparatus 200 at least with respect to FIGS. 2-4 is relevant to the description of the apparatus for moving tubular rotary slips described herein. Accordingly, similarly labeled components have similar form and function unless otherwise noted herein. The apparatus 200 includes the base plate 202 shown in FIG. 6 on the surface adjacent a rotary table 502 of a wellbore. In FIG. 6, the apparatus 200 is shown in the second (or retracted) position in which the rotary slips 504 are in an open position and positioned outside of the bowl 506 of the rotary table 502. In this retracted position, the rotary slips 504 are also positioned away from the front edge 234 of the base plate 202. This position may be interchangeably referred to as a stored position unless otherwise noted herein. The base plate 202 may include a front edge 234 having a curved cut out 508 that may be sized and shaped to surround some or all of the bowl 506 of the rotary table 502. The apparatus 200 may also include a sliding base 204, at least one cylinder 226, a base plate 202 having one or more tracks 206 for the sliding base 204 to slide along, a linkage assembly, and a lifting arm 212, as depicted in FIGS. 2-4. The linkage assembly may include a link arm 220 and one or more springs 224 as described in detail above. The position of the rotary slips 504 may be controlled by the position of the link arm 220 and the sliding base 204 and the position of the link arm 220 may be controlled by the position of the lifting arm 212. As further shown in FIG. 6, air supply lines 510 may couple at least the cylinder 226 (and/or the additional cylinder 242, not shown) to an air supply (not shown) for controlling actuation of the pneumatic cylinders (e.g., the cylinder 226 and/or the additional cylinder 242) for controlling the position of the sliding base 204 and the lifting arm 212. In some aspects, the cylinder 226 and/or the additional cylinder 242 may be hydraulic cylinders coupled to a hydraulic fluid supplied via one or more hydraulic lines. As shown in FIG. 5, the base plate 202 may be secured to the rotary table 502 via one or more bushing pins 512 that may be positioned proximate the front edge 234 of the base plate 202.

Figure 8:
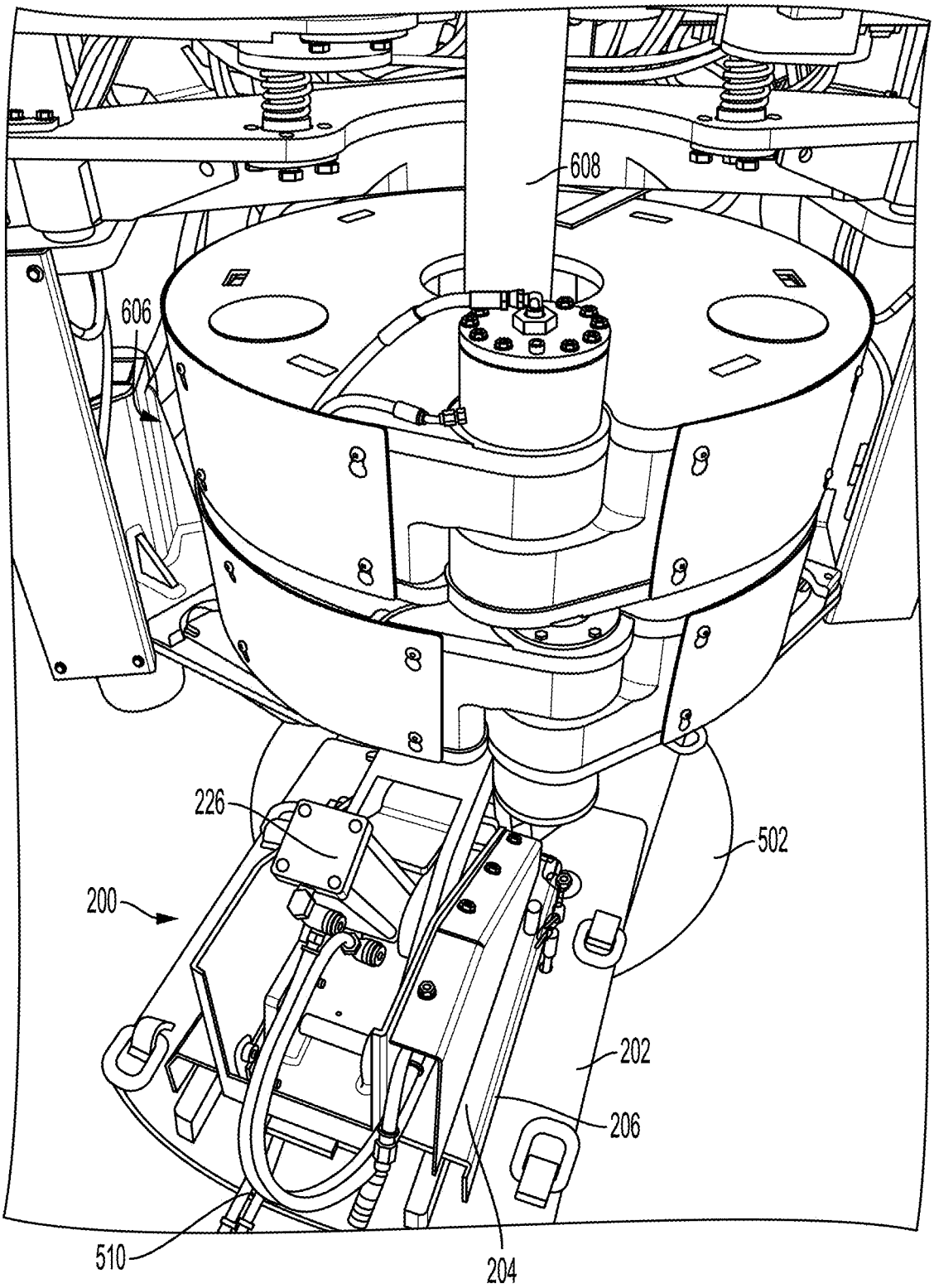
FIG. 8 an enlarged, overhead view of an apparatus with a torque wrench positioned about a drillpipe, in accordance with some embodiments of the present disclosure.

With the base plate 202 secured to the rotary table 502, a tubular body or a joint of pipe may be positioned within the bowl 506 of the rotary table 502 (e.g., when running a drillpipe downhole). In various embodiments, the apparatus 200 may be positioned adjacent the opening in the rotary table 502 after a joint of pipe has been positioned within the bowl 506 of the rotary table 502 (e.g., when tripping a drillpipe out of the wellbore). The apparatus 200 may be actuated to move the rotary slips 504 from the stored position (e.g., as shown in FIG. 6) to a secured or engaged position in which the rotary slips 504 surround the pipe and extend into the bowl 506 of the rotary table 502, as shown in FIGS. 7 and 8.

FIG. 7 illustrates the apparatus 200 in a first (secured or engaged) position in which rotary slips surround a drillpipe and extend into the bowl of a rotary table. Description of apparatus 200 at least with respect to FIGS. 2-5 is relevant to the description of the apparatus in the secured or engaged position in which rotary slips surround a drillpipe and extend into the bowl of a rotary table described herein. Accordingly, similarly labeled components have similar form and function unless otherwise noted herein. The position of the rotary slips 504 may be controlled via the position of the sliding base 204 and the lifting arm 212, as well as the one or more springs 224. The position of the sliding base 204 and the lifting arm 212 may be controlled by actuation of one or more cylinders, such as cylinder 226, as described above. For example, the sliding base 204 may be moved relative to the base plate 202 along the one or more tracks 206 by actuation of the cylinder 226 and/or an additional cylinder, such as additional cylinder 242, not shown. Similarly, the position of the lifting arm 212 may be controlled by the cylinder 226 coupled thereto. The link arm 220 may be positioned relative to the lifting arm 212 via its coupling to the lifting arm 212 at the pivot point. The position of the rotary slips 504 may also be defined by the position of the sliding base 204 and the lifting arm 212. In addition, the position of the rotary slips 504 may also be affected by the one or more springs 224. For example, when the lifting arm 212 retracts to the stored position the one or more springs 224 may aid in moving the rotary slips 504 in a rearward direction towards the rear 602 of the base plate 202 to the stored position.

To actuate the rotary slips 504 from the stored position to the secured position the sliding base 204 may be actuated by the cylinder 226 and/or additional cylinder 242 (not shown) to move towards the front edge 234 of the base plate 202 and the lifting arm 212 may be actuated via the cylinder 226 to move in a downward direction, toward the rotary table 502, with the link arm 220 rotating in a downward direction relative to the lifting arm 212. FIG. 7 depicts the apparatus 200 and the rotary slips 504 in the secured position. In this position, the rotary slips 504 at least partially surround the pipe 604. The rotary slips 504 may further engage the pipe 604 with one or more projections (not shown) on their respective curved faces. The rotary slips 504 may secure the pipe 604 in position for connecting an additional piece of pipe (not shown), and therefore may prevent the pipe 604 from moving relative to the rotary table 502 and the additional joint of pipe. For example, an additional joint of pipe may be screwed onto to the pipe 604 secured by the rotary slips 504 by rotating the additional pipe while the rotary slips 504 hold the initial pipe (e.g., pipe 604) in place. In some various embodiments, the additional pipe may be rotated via a machine such as a torque wrench or the like.

An exemplary torque wrench 606 is shown in FIG. 7 that may aid in retaining the lower pipe (e.g., pipe 604) in place while rotating the additional pipe 608 positioned above for joining the two lengths of pipes (e.g., pipe 604 and additional pipe 608) together. In some aspects more than one joint of pipe may be added to the drillstring at a time, such as when two or three previously coupled drill pipes (such as a stand) are added to the drillstring. In some embodiments of the present disclosure, the apparatus 200 may also be used during drilling of the wellbore such that the rotary slips 504 may permit the pipe 604 to rotate. FIG. 8 is an enlarged, overhead view of an apparatus with a torque wrench positioned about the additional pipe 608.

Figure 9:
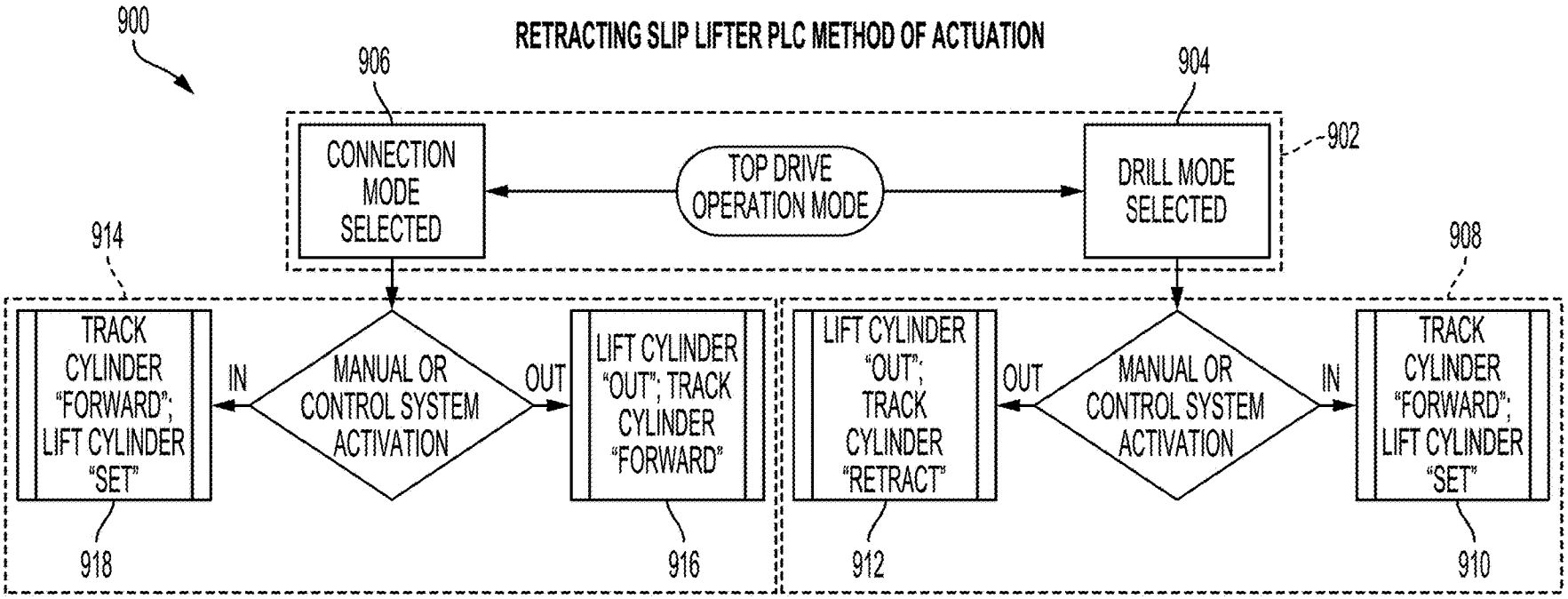
FIG. 9 includes a flowchart of operations of an apparatus, in accordance with some embodiments of the present disclosure.
Figure 10:
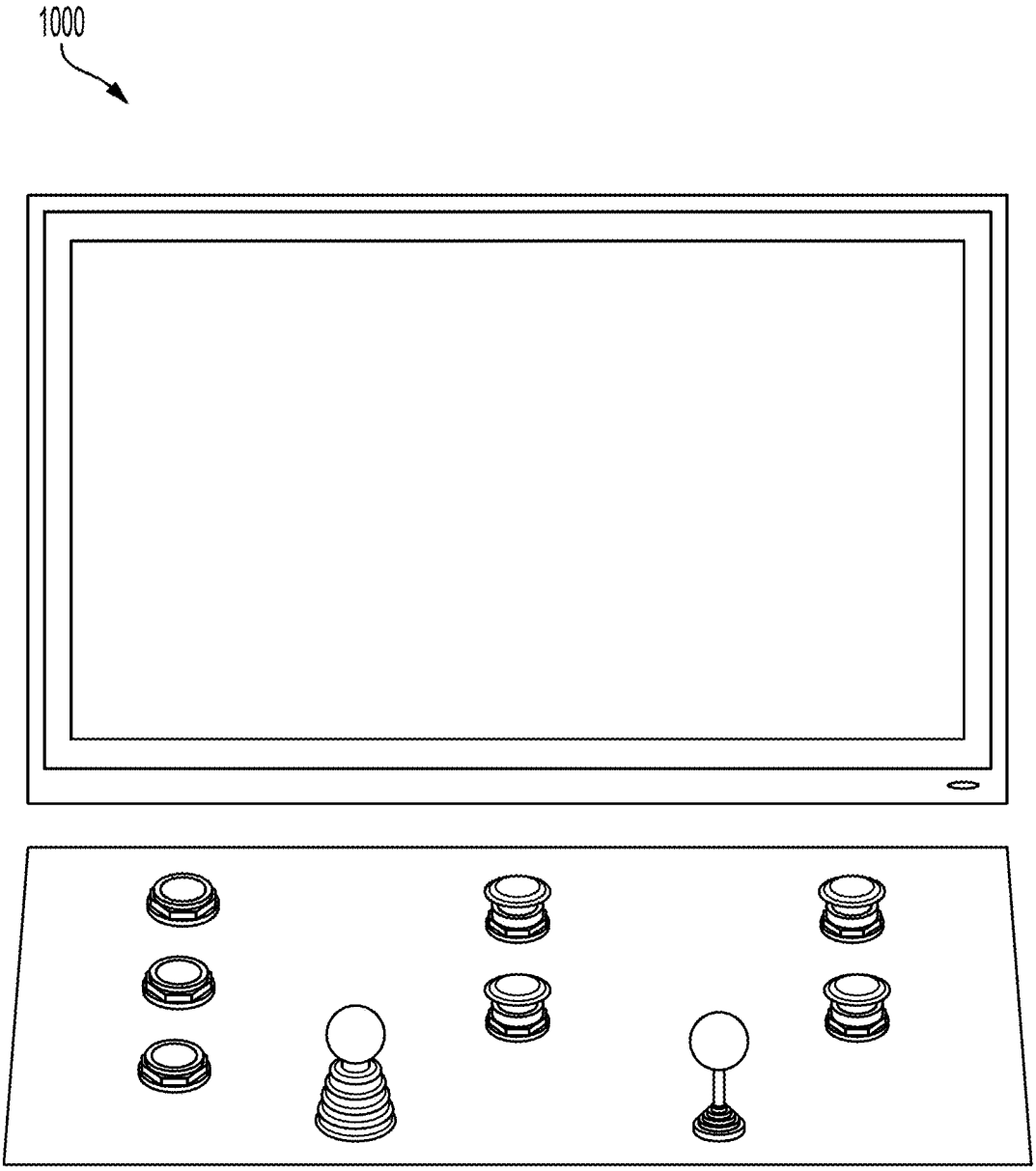
FIG. 10 illustrates a control system for an apparatus, in accordance with some embodiments of the present disclosure.

FIG. 9 includes a flowchart of operations of an apparatus 200. Description of apparatus 200 at least with respect to FIGS. 2-9 is relevant to the description of the flowchart of operations of an apparatus described herein. Accordingly, similarly labeled components have similar form and function unless otherwise noted herein. As shown in FIG. 9, method 900 includes step 902. According to step 902, an operator may select a particular mode of operation. A mode of operation may include a drill mode 904 or a connection mode 906 for the apparatus, such as apparatus 200 described in detail above. Advantageously, the operator may be remotely located from the apparatus during one or more steps described with respect to method 900. A rig crew does not need to physically place rotary slips around the drillpipe according to various embodiments described herein. Thus, the apparatus 200 and its use should enhance safety and limit the risk of injury to personnel working on the drilling rig.

In drill mode 904, at step 908, the operator or a control system (shown and described in further detail with respect to FIG. 9) may actuate 910 the apparatus 200 in one direction (e.g., inwardly) to track the cylinder, such as cylinder 226 and/or additional cylinder 242, or rotary slips, such as rotary slips 504, in a forward direction toward the pipe, such as pipe 604, and actuate the cylinder or rotary slips to set the rotary slips relative to the pipe. Alternatively, at step 908, the operator or control system may also choose to actuate 912 the apparatus in a second direction (e.g., outwardly) to actuate the cylinder or rotary slips out away from the pipe and retract the cylinder or rotary slips from the pipe. While historically rotary slips are set manually by a user approaching the rotary tablet and setting the rotary slips relative to the pipe or removing the rotary slips from the pipe, the apparatus 200 described herein and actuated in step 908 performs these operations with the user controlling the apparatus remotely, thereby lowering the risk of the rig crew for injury or death resulting from operating in close proximity to heavy lifting equipment. In some embodiments, the apparatus 200 operates automatically in response to a predetermined workflow. The rotary slips and the apparatus 200 may be remotely controlled and thereby moved between a stored position and a secured position in accordance with various embodiments described herein.

Similarly, in the connection mode 906, at step 914 the operator or control system may actuate 916 the apparatus in one direction (e.g., inwardly) to track the cylinder or rotary slips in a forward direction toward the pipe and actuate the cylinder or rotary slips to set the rotary slips relative to the pipe. Alternatively, at step 914, the operator or control system may also choose to actuate 918 the apparatus in a second direction (e.g., outwardly) to actuate the cylinder or rotary slips out away from the pipe and track the cylinder or rotary slips in a forward direction toward the pipe.

To disengage the rotary slips from the pipe, the apparatus may again actuate the one or more cylinders to release the rotary slips from the pipe and retract the rotary slips from their engaged position within the bowl to the stored position without intervention of the rig crew. According to some embodiments of the present disclosure, the rotary slips may be retracted to a position that is different from the stored position. Again, the position of the rotary slips relative to the apparatus may be controlled by the position of the lifting arm and the sliding base of the apparatus, as well as the one or more springs. The position of the lifting arm and the sliding base of the apparatus may further be controlled by the one or more cylinders.

FIG. 9 illustrates a control system for an apparatus. Description of apparatus 200 at least with respect to FIGS. 2-8 is relevant to the description of the control system for an apparatus described herein. Accordingly, similarly labeled components have similar form and function unless otherwise noted herein. The one or more cylinders (such as cylinder 226 and/or additional cylinder 242) may be controlled by a control system 1000. The control system 1000 may include a PLC. The control system 1000 may receive instructions from an operator via either a wired or wireless connection. In some aspects, the control system 1000 may receive instructions via a second control system (not shown). The control system may selectively move the sliding base, such as sliding base 204, and the lifting arm, such as lifting arm 212, in response to a command from an operator or a second control system to actuate the apparatus, such as apparatus 200 described in detail above with respect to other FIGS. 2-8, and thereby the rotary slips, such as rotary slips 504, between at least a first position and a second position. For example, the rotary slips 504 may be lifted and lowered between at least a stored position and a use position. Exemplary apparatus 200 may perform methods for lifting tubular rotary slips as disclosed herein. For example, an exemplary apparatus 200 may actuate rotary slips between a first position and a second position by actuating one or more cylinders that control the position of a sliding base and a lifting arm. In addition, one or more springs coupled between the rotary slips and the link arm coupled to the rotary slip may also aid in guiding the rotary slips into position within the bowl of a rotary table. By using a linkage assembly that may include a universal linkage adapter the apparatus may be connected to multiple rotary slip brands, manufacturers, sizes, and/or models.

Figure 11:
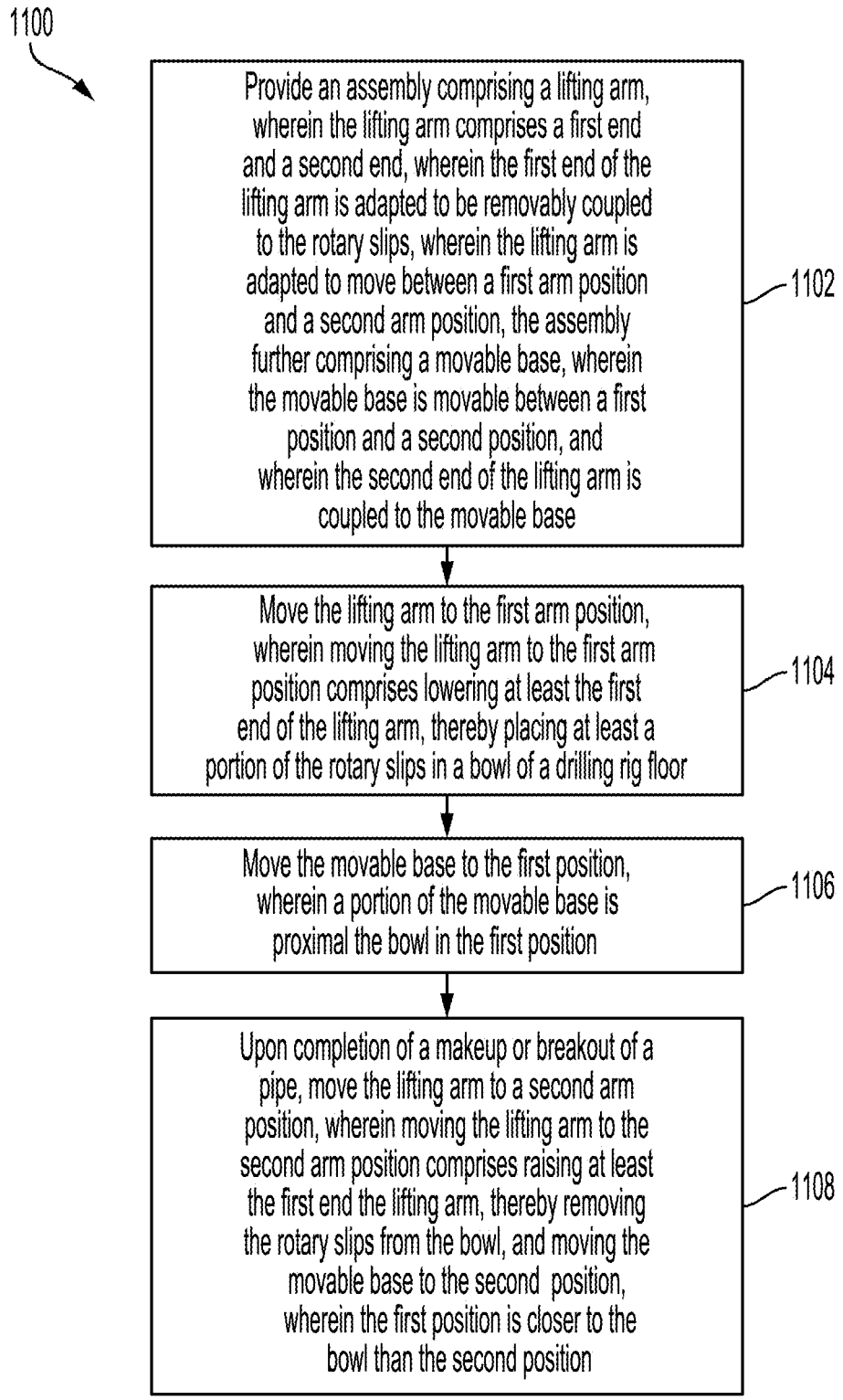
FIG. 11 includes a flowchart of a method of controlling movement of rotary slips using an apparatus, in accordance with some embodiments of the present disclosure.

FIG. 11 is flowchart of a method of controlling movement of rotary slips using an apparatus. Description of apparatus 200 at least with respect to FIGS. 2-8 is relevant to the description of the method described herein. Method 1100 includes various steps that may be performed in other configurations than those explicitly described herein. Method 1100 may include more or less steps than those described herein. Method 1100 includes step 1102. Step 1102 includes providing an assembly comprising a lifting arm. The assembly may be an apparatus such as apparatus 200 including some or all of the embodiments described in detail above. The lifting arm may include a first end and a second end where the first end of the lifting arm is adapted to be removably coupled to the rotary slips and the arm is further adapted to move between a first arm position and a second arm position. The assembly may further include a movable base that is movable between a first use position and a second stored position. The second end of the arm may be coupled to the movable base as shown at least in FIG. 2.

Method 1100 includes step 1104 for moving the arm to a first arm position. Moving the arm to a first arm position includes lowering at least the first end of the arm, thereby placing at least a portion of the rotary slips in a bowl of a drilling rig floor. Placing rotary slips relative to a rotary table is conventionally performed by a rig crew, thereby placing them at risk of injury if a limb or the like gets stuck between the rotary slips and a drillpipe during placement. A benefit of the assembly (e.g., apparatus 200) provided herein includes enabling remote placement of the rotary slips. Method 1100 further includes step 1106. Step 1106 moving the movable base to a first use position. A first use position may provide that a portion of the movable base is proximal the bowl in the first use position. Step 1104 and step 1106 may be performed in unison or in opposite order as would be appreciated by one having ordinary skill in the art. For example, the moveable base may be positioned at the first use position and then the arm may be lowered to the first arm position such that a portion of the rotary slips extend into the bowl of the drilling rig floor. In some embodiments, a base track plate attached to the drilling rig floor may be provided and adapted to allow movement of the moveably base thereon.

Step 1108 includes, upon completion of a makeup or breakout of a pipe, moving the arm to a second arm position. Moving the arm to the second arm position may include raising at least the first end the arm, thereby removing the rotary slips from the bowl. Step 1108 may further include moving the movable base to a second stored position. Moving the arm to the second arm position and moving the movable base to a second stored position may be performed interchangeably. According to at least some embodiments, the first use position is closer to the bowl than the second stored position.

In various embodiments, the assembly further includes a control system coupled to the arm and the movable base. The control system may be adapted to control the movement of the arm or the movable base. The control system may be further adapted to control the movement of the arm and the movable base simultaneously. The control system may receive one or more signals indicating that a makeup or breakout has been completed, is in process, or is about to begin. The control system may also initiate, cease, slow, or increase a speed of operation of the arm or the movable base in response to one or more signals indicating an unsafe condition.

In some embodiments, method 1100 may include replacing the rotary slips with additional rotary slips that adapted for different pipe diameters. As described above, the assembly may be used with one or more types, design, sizes, etc., of rotary slips. In particular, different pipe diameters or materials may be suitable for different rotary slips.

The subject matter of embodiments of this patent is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Different arrangements of the components depicted in the drawings or described above, as well as components and steps not shown or described, are possible. Similarly, some features and subcombinations are useful and may be employed without reference to other features and subcombinations. Embodiments of the disclosure have been described for illustrative and not restrictive purposes, and alternative embodiments will become apparent to readers of this patent. Accordingly, the present disclosure is not limited to the embodiments described above or depicted in the drawings, and various embodiments and modifications can be made without departing from the scope of the claims below.

We claim:

1. A rotary slips lift system for oilfield tubulars, the system comprising:

a movable base adapted to move between a first position and a second position, wherein the first position is closer to a bowl in a drilling rig floor than the second position;

a lifting arm having a first end and a second end, wherein the second end is pivotally coupled to the movable base, and wherein the lifting arm has a first arm position and a second arm position;

a rotary slips, wherein the rotary slips is removably coupled to the first end of the lifting arm, wherein the rotary slips is adapted to be in a first slips position when the lifting arm is in the first arm position and the movable base is in the first position, and the rotary slips is adapted to be in a second slips position when the lifting arm is in the second arm position and the movable base is in the second position, and wherein the first slips position comprises being at least partially located in the bowl and the second slips position comprises being out of the bowl, and wherein the lifting arm is adapted to lift the rotary slips out of the bowl when moving from the first arm position to the second arm position; and a linkage assembly, wherein the linkage assembly removably couples the first end of the lifting arm to the rotary slips, and wherein the linkage assembly comprises a pinned universal linkage adapter and at least one spring.

2. The rotary slips lift system of claim 1, wherein the first end of the lifting arm is removably coupled to the rotary slips by an adapter that is operable to be removably coupled to a plurality of rotary slips of different dimensions.

3. The rotary slips lift system of claim 1, further comprising a base plate track, wherein the movable base is movably mounted on the base plate track.

4. The rotary slips lift system of claim 1, further comprising a trunnion mounted cylinder adapted to move the lifting arm between the first arm position and the second arm position.

5. The rotary slips lift system of claim 1, further comprising a cylinder mounted to the movable base and adapted to move the movable base between the first position and the second position.

6. The rotary slips lift systems of claim 1, further comprising a control system coupled to the movable base and the lifting arm, wherein the control system is adapted to selectively move the movable base and the lifting arm in response to an operator command therefor.

7. The rotary slips lift system of claim 1, further comprising a control system coupled to the movable base and the lifting arm, wherein the control system is adapted to automatically move the movable base and the lifting arm in response to a control signal from a second control system.

8. The rotary slips lift system of claim 7, wherein the control signal is associated with a signal indicating that a make-up has been completed or a breakout has been completed.

9. A method of controlling movement of rotary slips, the method comprising:

providing an assembly comprising a lifting arm, wherein the lifting arm comprises a first end and a second end, wherein the first end of the lifting arm is adapted to be removably coupled to the rotary slips, wherein the lifting arm is adapted to move between a first arm position and a second arm position, the assembly further comprising a movable base, wherein the movable base is movable between a first position and a second position, and wherein the second end of the lifting arm is coupled to the movable base;

moving the lifting arm to the first arm position, wherein moving the lifting arm to the first arm position comprises lowering at least the first end of the lifting arm, thereby placing at least a portion of the rotary slips in a bowl of a drilling rig floor;

moving the movable base to the first position, wherein a portion of the movable base is proximal the bowl in the first position; and upon completion of a makeup or breakout of a pipe, moving the lifting arm to the second arm position, wherein moving the lifting arm to the second arm position comprises raising at least the first end of the lifting arm, thereby removing the rotary slips from the bowl, and moving the movable base to the second position, wherein the first position is closer to the bowl than the second position.

10. The method of claim 9, further comprising replacing the rotary slips with additional rotary slips, wherein the rotary slips and additional slips are adapted for different pipe diameters.

11. The method of claim 9, further comprising providing a base track plate attached to the drilling rig floor and adapted to allow movement of the movable base thereon.

12. The method of claim 9, wherein the assembly further comprises a control system coupled to the lifting arm and the movable base, wherein the control system is adapted to control the movement of the lifting arm or the movable base.

13. The method of claim 12, wherein the control system is adapted to control the movement of the lifting arm and the movable base simultaneously.

14. The method of claim 13, wherein the control system is adapted to receive one or more signals indicating that a makeup or breakout has been completed, is in process, or is about to begin.

15. The method of claim 14, wherein the control system is adapted to initiate, cease, slow, or increase a speed of operation of the lifting arm or the movable base in response to one or more signals indicating an unsafe condition.

16. A rotary slips system, the system comprising:

a movable base adapted to move between a first position and a second position, wherein the first position is closer to a bowl in a drilling rig floor than the second position;

a lifting arm having a first end and a second end, wherein the first end of the lifting arm is adapted to be removably coupled to a slips and the second end of the lifting arm is pivotally coupled to the movable base, and wherein the lifting arm has a first arm position and second arm position, wherein the first end of the lifting arm is lower in the first arm position than in the second arm position, and wherein when the lifting arm is in the first arm position and the movable base is in the first position and a slips is coupled to the first end of the lifting arm, the slips is located at least partially in the bowl, and wherein when the lifting arm is in the second arm position and the movable base is in the second position, the slips is out of the bowl;

means for moving the lifting arm; and means for moving the movable base.

17. The rotary slips system of claim 16, further comprising a control system coupled to the lifting arm or the movable base, wherein the control system is adapted to move the lifting arm or the movable base, respectively, in response to a user command.

18. The rotary slips system of claim 16, further comprising a control system coupled to the lifting arm and the movable base, wherein the control system is adapted to control movement of the lifting arm and the movable base.

19. The rotary slips system of claim 16, further comprising a control system coupled to the lifting arm and the movable base, wherein the control system is adapted to control movement of the lifting arm and the movable base responsive to a signal indicating completion of a makeup or breakout.

* * * * *